US008066097B2

(12) United States Patent
Boyadjian et al.

(10) Patent No.: US 8,066,097 B2
(45) Date of Patent: Nov. 29, 2011

(54) ACOUSTIC ENHANCEMENT DEVICE FOR UNDERLAYMENT OF A COVERING

(75) Inventors: Pierre Boyadjian, Chambery (FR); David Fournier, Breteuil (FR); Serge Rimlinger, Seyssinet Pariset (FR); Michele Curt, Peronnas (FR); Cedric Chaveyriat, Ceyzeriat (FR)

(73) Assignee: Saint-Gobain Weber France, Servon (FR)

( * ) Notice: Subject to any disclaimer, the term of this patent is extended or adjusted under 35 U.S.C. 154(b) by 0 days.

(21) Appl. No.: 12/506,537

(22) Filed: Jul. 21, 2009

(65) Prior Publication Data

US 2010/0018799 A1 Jan. 28, 2010

(30) Foreign Application Priority Data

Jul. 24, 2008 (FR) ..... 08 55084

(51) Int. Cl.
*E04B 1/14* (2006.01)

(52) U.S. Cl. ..... 181/290; 181/285; 181/286

(58) Field of Classification Search ..... 181/285, 181/286, 290; 52/403.1
See application file for complete search history.

(56) References Cited

U.S. PATENT DOCUMENTS

| | | | | |
|---|---|---|---|---|
| 4,488,619 | A * | 12/1984 | O'Neill | 181/290 |
| 5,483,028 | A * | 1/1996 | Holwerda | 181/207 |
| 5,554,830 | A * | 9/1996 | Muller et al. | 181/290 |
| 5,814,170 | A * | 9/1998 | Shibusawa et al. | 156/62.2 |
| 5,916,681 | A * | 6/1999 | Cipin | 428/403 |
| 6,145,617 | A * | 11/2000 | Alts | 181/290 |
| 7,201,253 | B2 * | 4/2007 | Duval et al. | 181/204 |
| 7,320,739 | B2 * | 1/2008 | Thompson et al. | 156/308.2 |
| 7,322,440 | B2 * | 1/2008 | Khan et al. | 181/286 |
| 2002/0088193 | A1 * | 7/2002 | Reimers et al. | 52/403.1 |
| 2004/0154240 | A1 * | 8/2004 | Hiraguri et al. | 52/144 |
| 2005/0150720 | A1 * | 7/2005 | Tudor et al. | 181/286 |
| 2005/0214500 | A1 * | 9/2005 | Hallows | 428/77 |
| 2006/0131103 | A1 * | 6/2006 | Fuller et al. | 181/290 |
| 2007/0119651 | A1 * | 5/2007 | Mori et al. | 181/290 |
| 2007/0227090 | A1 * | 10/2007 | Plante | 52/506.01 |
| 2007/0289238 | A1 * | 12/2007 | Payne et al. | 52/408 |

FOREIGN PATENT DOCUMENTS

| | | | |
|---|---|---|---|
| JP | 05248076 | A * | 9/1993 |
| JP | 11293810 | A * | 10/1999 |

OTHER PUBLICATIONS

Machine translation of JP 05248076 A.*

* cited by examiner

*Primary Examiner* — Jeremy Luks
(74) *Attorney, Agent, or Firm* — Oblon, Spivak, McClelland, Maier & Neustadt, L.L.P.

(57) ABSTRACT

An acoustic enhancement device adapted for being placed on a support and under a covering, and containing a first flexible layer adapted for being placed facing the support, a second rigid layer joined to the first flexible layer and adapted for being placed opposite the support, and a damping element, wherein the damping element is integrated in the second rigid layer or forms a third layer placed on the second rigid layer and opposite the first flexible layer.

17 Claims, 3 Drawing Sheets

ACOUSTIC ENHANCEMENT DEVICE FOR UNDERLAYMENT OF A COVERING

REFERENCE TO PRIOR APPLICATIONS

This application claims priority to French patent application 08 55084, filed Jul. 24, 2008, incorporated herein by reference.

FIELD OF THE INVENTION

The invention relates to an acoustic enhancement device for accommodating a covering, in particular a floor covering such as tiling, parquet, plastic covering, carpet or other. The acoustic device may also constitute an underlayment or underlayer for floor or ceiling covering.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The description is to be regarded as illustrative in nature, and not as restrictive.

BACKGROUND OF THE INVENTION

In the field of acoustic enhancement, a distinction is mainly drawn between enhancement by acoustic insulation and enhancement by acoustic correction.

Acoustic insulation ensures reducing the transmission of sound from one room to another, whether via the floor, the ceiling or the side walls. Acoustic insulation reduces sound of mechanical origin, such as impact or collision sound, and also airborne sound, such as generated by persons speaking or hi-fi systems.

Acoustic correction ensures decreasing the sound in the room where the acoustic source is located. Acoustic correction applies to sound of mechanical origin and airborne sound. In the case of sound of mechanical origin on a floor, this is referred to as acoustic correction of walking sound.

Various acoustic isolating devices are known as underlayers for floor coverings. Mention can be made of the use of cork tiles, of rubber based underlayers, which are in the form of tiles or consist of a leveling screed, or of underlayers based on generally synthetic fibers.

Patent EP 0 413 626 B1 more particularly describes a device for insulation against impact sound. It concerns a soundproofing tile having a hard surface with regard to the covering to be placed, and having an elastic reaction support on the opposite side. It comprises a dense and flexible layer of supercompressed fibers having a density between 60 and 200 kg/m$^3$ which constitutes the elastic reaction support, and a layer of bitumen reinforced with two thin layers of glass fibers anchored respectively in each of the faces of the bitumen layer to constitute the rigid face of this tile, the rigid layer having a thickness of about 5 to 6 mm with a mass per unit area of about 10 kg/m$^2$.

Document FR2517728 proposes the same type of product.

Document US 2005/0214500 also addresses the problem of sound transmission by proposing an underlayer formed of a layer having a certain resilience, between 2 and 10 mm thick and having a density of between 20 and 150 kg/m$^3$, and overlaid by a rigid layer having a modulus of elasticity of between 3 and 18 GPa, and not over 14 mm thick.

Document FR 2 693 221 also proposes a solution for insulation against impact sound, but is in the form of rolls. This underlayer comprises a main layer which is placed on the covering side and a secondary layer which is arranged on the opposite side, the floor side.

The secondary layer of this underlayer provides acoustic attenuation with regard to impact sound due to the very constitution of its cellular material which is elastically deformable. This material is, for example, based on a polymer of the polyvinyl chloride (PVC), polyurethane rubber (PUR), polyethylene (PE), styrene-butadiene rubber (SBR) type, and has a thickness between 0.1 mm and 5 mm, with a density not exceeding 800 kg/m$^3$.

The main layer of the underlayer serves to provide the overall mechanical strength. Its constituent material is, for example, a synthetic polymer such as polyvinyl chloride (PVC), a polypropylene (PP), polyethylene (PE), or a bitumen, but it may also be made from materials of natural origin such as wood fibers. This layer is relatively hard on the surface but remains sufficiently flexible to be rolled so that the underlayer can be provided in the form of rolls.

Document FR2752859 teaches a multilayer material to be placed under a floor covering to reinforce the acoustic insulation against impact zone, and in general to attenuate the propagation of sound waves. This multilayer material, between 3 and 7 mm thick, comprises a first layer facing the floor, consisting of flexible fibrous materials having a mass per unit area of at least 200 g/m$^2$ and which serves to dampen the sound waves, and the second layer facing the covering which is formed of a glass fiber grid or fabric having a mass per unit area of between 300 and 900 g/m$^2$ and which promotes the spreading of the sound waves. A cellular layer of the polyurethane foam type may also be provided, to be placed on the floor opposite the first layer.

It is an object of the invention to provide an alternative solution to the existing solutions for acoustic insulation against impact sound and against airborne sound and, above all, to guarantee an efficient correction of walking sound, while providing great ease of installation.

Figure 1:
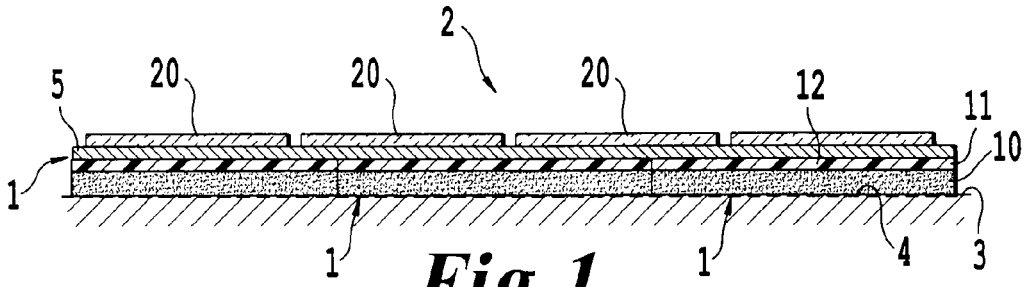
FIG. 1 shows a schematic cross section of an acoustic device according to a first embodiment of the invention, integrated as an underlayer or underlayment of a floor covering.

The figures are not to scale to make them easier to read.

DETAILED DESCRIPTION OF THE PREFERRED EMBODIMENTS

According to the invention, the acoustic enhancement device intended and adapted for being placed on a support and under a covering, comprises a first flexible layer intended and adapted for being placed facing the support, a second rigid layer joined to the first flexible layer and intended and adapted for being placed opposite the support, and a damper (also referred to as a damping element), characterized in that the damper is integrated in the second rigid layer or forms a third damping layer placed on the second rigid layer and opposite the first flexible layer.

The invention thus proposes a device which, in addition to the acoustic insulation that it provides due to the flexible layer, serves to provide an acoustic correction with regard to walking sound thanks to the damper which is placed on or in the rigid layer.

The inventors have demonstrated that the order of the elements in the final device to be placed against the support is important with regard to the acoustic enhancement results obtained. They have accordingly shown that it is preferred for the damper to be placed in the rigid layer, or on the rigid layer and opposite the flexible layer.

The rigid layer is believed to provide the mechanical strength of the whole acoustic device, and to confer sufficient mechanical strength on the system formed by the device and the installed covering, while also absorbing the stresses applied to the flooring. The stiffness of this layer promotes the enhancement by acoustic correction to impact sounds due to the fact that the damping element is sandwiched between two rigid elements, said layer and the covering.

In a first embodiment in which the rigid layer integrates the damper, the latter has, at 20° C. and at 1000 Hz, a loss factor tan δ at least equal to 0.06, preferably higher than 0.1. The loss factor tan δ at 1000 Hz and 20° C. is evaluated by the measurement method described in document ISO PAS 16940 by selecting, during the post-processing, the resonance frequency closest to 1000 Hz.

The damper integrated in the rigid layer is advantageously in the form of aggregates such as balls, granules, scraps of recycled material. Etc.

In a second embodiment in which the damper is formed by a damping layer as such, this layer has, at 1000 Hz and 20° C., a loss factor tan δ at least equal to 0.3, preferably higher than 1, and a dynamic Young's modulus E' of between 5×10 Pa and $10^8$ Pa. In this case, the loss factor tan δ and the dynamic Young's modulus E' are measured using a viscoanalyzer, a known measuring instrument for materials, in particular viscoelastic materials.

In the second embodiment, the damping layer can comprise, consist essentially of, or consist of one or more viscoelastic plastic material(s) which themselves comprise, consist essentially of, or consist of a sheet, a film, a poured resin, or a spreadable material. It may comprise, consist essentially of, or consist of adhesive intended for bonding a covering to the device.

Integrated in the rigid layer or forming a third layer, the damper can comprise, consist essentially of, or consist of, for example, one or more viscoelastic polymer material(s), of the EVA based polymer type, of the acrylic type, the polyvinyl butyral type, in particular the polyvinyl butyral type having enhanced acoustic damping properties.

According to one feature, the rigid layer considered separately without the damper has, at 20° C. and at 1000 Hz, a dynamic Young's modulus E' of at least $10^8$ Pa, and preferably between $10^9$ Pa and $30\times10^9$ Pa.

It is advantageously based on an organic or mineral binder, or on bitumen, or on agglomerated fibers, or on a synthetic composite material.

According to one feature, the flexible layer is a layer with open porosity, of the fibrous material(s) of mineral and/or synthetic origin type, of the glass fiber and/or polyester fiber type, of the synthetic cellular layer type, such as polyethylene or polyurethane, preferably having an apparent dynamic stiffness per unit area $s'_t$ lower than $8.8\times10^6$ N/m$^3$. "Open porosity" material means any fibrous or foamy material allowing air circulation in the layer.

Surprisingly, the inventors have demonstrated that the loss factor of the flexible layer is in fact not representative of the acoustic performance with regard to the insulation against impact sound. On the other hand, the apparent dynamic stiffness $s'_t$ per unit area proved to be a much more representative parameter of performance with regard to insulation against impact sound.

The measurement of the dynamic stiffness per unit area $s'_t$ is described in greater detail later in the description, based on standard NF EN 29052-1 which relates to the method for evaluating the apparent dynamic stiffness per unit area of materials used in floating floors in residential buildings.

The flexible layer preferably has a thickness dF Of between 3 mm and 7 mm under a load of 2 kPa, including 4, 5, and 6 mm and all values and subranges between stated values.

The flexible layer is believed to serve to disengage the covering from the support (wall, floor or ceiling), thereby preventing the transmission of vibratory energy into the adjacent room.

The acoustic enhancement device of the invention may therefore be used to advantage as an underlayer for floor, wall or ceiling covering. The covering is joined to the damping layer, or to the rigid layer when the latter integrates the damper. The inventors have thus demonstrated that the damper is advantageously arranged between the covering, which is a rigid element, and the rigid layer, thereby enabling the damping element to be deformed and to work in shear, to dissipate the vibratory energy and thereby to provide an acoustic correction.

Various presentations of the device can be considered with regard to its combination with a support.

The device may have the form of a plate and comprise, joined to the flexible layer, the rigid layer and the damping element which is integrated in the rigid layer or which constitutes a third layer.

As an alternative, the first flexible layer is in the form of a roll to be spread and to be cut to the dimensions of the surface of the support to be covered. The second rigid layer integrating the damping element or not, and optionally the damping layer, can then be joined together in the form of a plate.

FIGS. 1 to 8 show various alternative embodiments of an acoustic enhancement device 1 according to the invention for a floor covering 2 shown here as an example by ceramic tiles 20.

The device 1 is placed against the floor 3 and joined thereto by bonding material 4. The floor covering 2 is placed against the device 1 by common bonding material 5.

The inventive device comprises, according to the invention, a first layer 10 for being positioned facing the floor 3, a second layer 11 which is associated with the first layer and placed opposite of floor 3, and damping element 12 or 13.

The first layer 10 preferably has an open porosity and has a degree of elasticity. It is intended to provide acoustic insulation against impact sound.

It is made for example from at least one fibrous material which may be of mineral or synthetic origin. By way of example, mention can be made of glass fibers, polyester fibers.

The layer 10 may be a mixture of fibrous materials which are combined together by the manufacturing process.

It may be a mixture of one or more fibrous materials, which are combined with a material binding them together, the layer preserving its open porosity.

The layer may preferably consist of a synthetic woolen heat-bonded nonwoven fabric, needled or not.

The layer may, as an alternative, be a mineral nonwoven fabric obtained by melting.

The layer may even, according to another alternative, be a cellular material such as a synthetic foam, of the polyurethane foam type.

The acoustic insulation performance of underlayers is characterized by the apparent dynamic stiffness per unit area $S'_t$. Standard NF EN 29052-1 describes the method for evaluating the apparent dynamic stiffness per unit area of the materials used in floating floors in residential buildings. A measurement is made of the resonance frequency of the fundamental vertical vibration of a spring/mass system for which the spring corresponds to the underlayer material and the mass corresponds to a load plate, the load plate being subjected to a vibratory excitation force.

Once adapted to thin underlayers, this standard can serve as a basis for evaluating the apparent dynamic stiffness per unit area of the flexible layer 10 of the invention. Considering the high non-linearity of the layers of open porosity materials and the leeway provided by the standard concerning the manner for exciting the load plate and concerning the post-processing of the measurements, it is important to clarify a number of points below to obtain the value of the apparent dynamic stiffness of the thin underlayer:

- an impedance head is placed at the center of the plate, the impedance head permitting to obtain the injected vibratory force F(f) and displacement X(f) data of the plate,
- the excitation applied to the load plate by a vibrating pot is of the sliding sine wave type between 1 Hz and 250 Hz throughout the measurement duration. The maximum voltage applied to the terminals of the vibrating pot is 20 mV.
- The measurement result is obtained by a mean of five successive measurements,
- the value of the apparent dynamic stiffness per unit area $s'_t$ is equal to the level of the low frequency asymptote of the ratio $|F/X|$.

According to the invention, the flexible layer 10 preferably has an apparent dynamic stiffness per unit area $s'_t$ measured according to the protocol defined above, lower than $8.8\times10^6$ $N/m^3$.

The nature of the flexible layer and its thickness are adapted so that the layer preferably has a thickness under load of 2 kPa measured according to standard NF EN 12431, preferably of between 3 and 7 mm.

If this first layer 10 has a degree of flexibility, the second layer 11, however, is rigid. It provides for the device a mechanical strength, a cohesion of the assembly of the components constituting the device, and allows to absorb all the mechanical stresses applied to the device when it is in place under the floor covering on which people walk.

The rigid layer 11 is characterized according to the invention by its dynamic Young's modulus E' at 1000 Hz and at 20° C. It preferably has a dynamic Young's modulus E' at 1000 Hz and at 20° C. of at least $10^8$ Pa, and more preferably of between 1 GPa and 30 GPa.

The dynamic Young's modulus E', at 1000 Hz and at 20° C., of the rigid layer 11, is estimated by the measurement method described in document ISO PAS 16940, selecting the resonance frequency closest to 1000 Hz during the post-processing.

The mass per unit area of the rigid layer 11 is preferably lower than 9.5 $kg/m^2$, which allows easy handling and manipulation of the product.

The rigid layer 11 is based for example on mineral binder, such as cement, gypsum, mortar, or based on bitumen, or agglomerated fibers such as plant fibers of the wood, hemp type, mineral fibers of the rock wool type or based on synthetic composite material such as synthetic fibers or synthetic resin, or even based on a mixture of fibers and resin.

The two layers 10 and 11 may be joined appropriately according to the type of material used for each of the layers, for example by bonding using adhesive of the water glue type, or by bonding by heat input.

According to a first embodiment shown in FIG. 1, the damping element 12 is integrated in the second layer 11. Although the second layer is rigid, it has a damping property and is accordingly characterized by the fact of the damping element, at 1000 Hz and at 20° C., by a loss factor tan δ which is at least equal to 0.06, preferably higher than 0.1. To measure the loss factor tan δ at 1000 Hz and at 20° C. of the rigid layer 11, the measuring method described in document ISO PAS 16940 is applied to the material constituting the rigid layer, selecting the resonance frequency closest to 1000 Hz during the post-processing. The value of the modal damping measured on the vibration peak is then identified, at the value of the loss factor tan δ. This is legitimate because the material is considered to be uniform.

Integrated with the second rigid layer 11, the damping element is preferably in the form of aggregates, the material of the rigid layer forming the binder. This comprises, consist essentially of, or consists of for example balls, granules, scrap of recycled material. The aggregates may have various sizes, from nanometer size to millimeter size, for example.

The quantity of damping material may be adapted according to the damping to be obtained, but nevertheless preferably in limited proportions so that the layer preserves adhesion properties, in particular with the covering to be bonded. For example, an addition of PVB representing 5% of the weight of the layer allows to double the damping level of the layer.

As an alternative, integrated with the second rigid layer, the damping element is in the form of a chemical component of the material of said rigid layer.

This second rigid layer including the damping element may be formed from a plate as we shall show below. It may, as an alternative, be in the form of a self-smoothing leveling screed based on cement.

Figure 2:
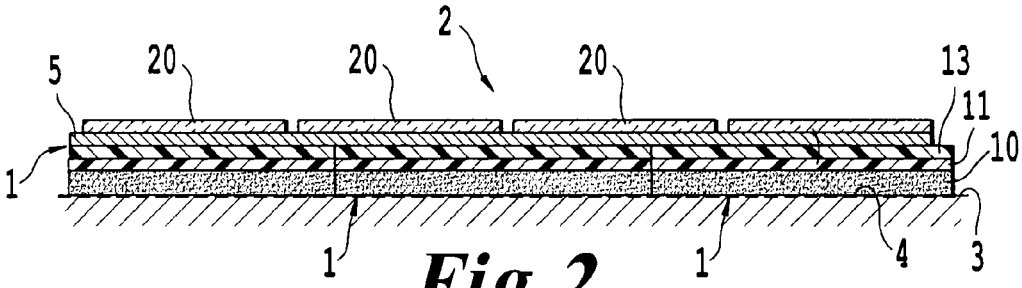
FIG. 2 shows a schematic cross section of an acoustic device according to a second embodiment of the invention, integrated as an underlayer or underlayment of a floor covering.

According to a second embodiment shown in FIG. 2, the damping element 13 forms a third layer in its own right which is placed on the second rigid layer 11 and opposite the first flexible layer 10.

In this example this third layer 13 is a viscoelastic material and is characterized, at 1000 Hz and 20° C., by a loss factor tan δ at least equal to 0.3, preferably higher than 1, and by a dynamic Young's modulus E' of between $5\times10^6$ Pa and $10^8$ Pa. The dynamic Young's modulus E' of the damping material and its loss factor are measured using a viscoanalyzer, a known measuring instrument for viscoelastic materials.

The damping element has the role of providing damping in the acoustic device 1 in order to reduce the amplitude of the waves propagating in the covering 2 and generated for example by walking, thereby decreasing the sound within the room. However, the inventors have demonstrated that the damping element must be present between two rigid elements to play its role fully.

The damping element may comprise, consist essentially of, or consist of one or more viscoelastic plastic materials. As materials, mention can be made of polymers of the acrylic type, the vinyl type, in particular polyvinyl butyral (PVB) having enhanced damping properties, called acoustic PVB. Mention can also be made of acoustic PVB with the trade name Saflex® Vanceva Quiet QC41 produced by Solutia, which has, at 20° C. and 1000 Hz, a loss factor tan δ of 1 and a Young's modulus E' of $5\times10^7$ Pa.

As a damping layer 13 in its own right, the damping element may be in the form of a sheet or a film, a poured resin or a spreadable material.

In particular, the spreadable material may be formed by adhesive, adhesive serving for bonding the covering 2, and comprising damping plastic material(s). It may for example be an acrylic glue with an acrylic based content preferably higher than 15%.

The joining of the damping layer 13 to the rigid layer 11 is obtained thanks to the adapted intrinsic tack of the damping layer 13 when it is a water glue, or by its heating when it is a polymer resin.

The device 1 as a whole can be constructed in various ways, examples of which are provided below.

Figure 3:
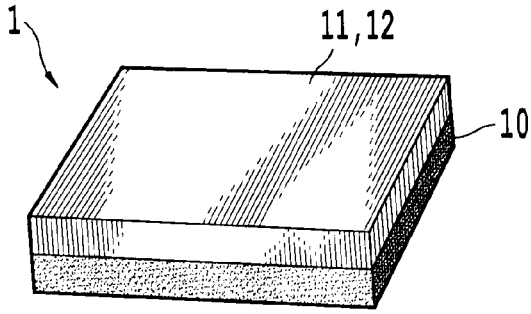
FIGS. 3 and 4 are perspective views of the acoustic devices used respectively in FIGS. 1 and 2.
Figure 4:
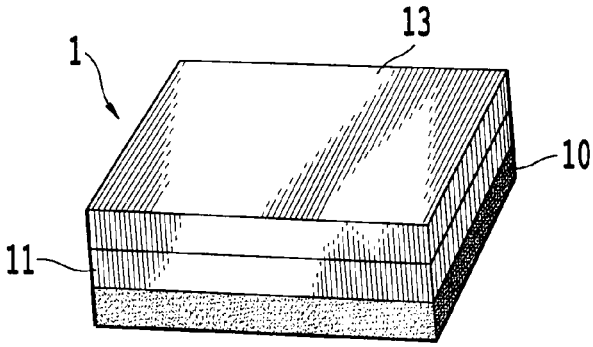

According to a first alternative embodiment, it forms a unitary assembly, such as a kit ready-for-use, which is intended to be placed against the support such as the floor 3, and on which the covering 2 is in turn positioned. Thus, the device in FIGS. 3 and 4 represents a plate, whereof a plurality is placed by bonding on the floor 3 as shown in FIGS. 1 and 2 respectively.

According to a second alternative embodiment, certain elements of the device are already assembled and form a unitary system, while the other remaining element or elements are placed individually during the application of the device as a covering underlayer or underlayment.

Figure 5:
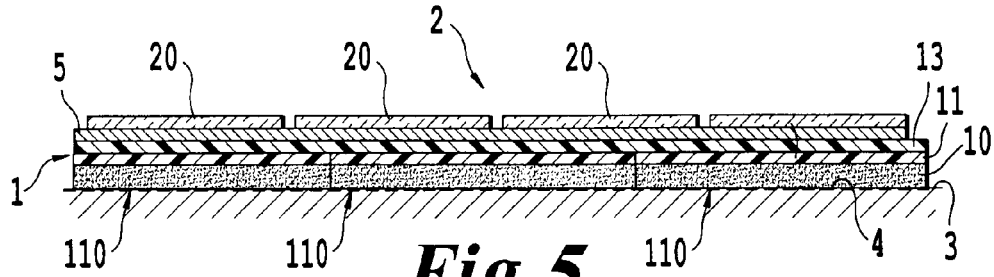
FIG. 5 shows a schematic cross section of an alternative embodiment of the acoustic device of the invention integrated as an underlayer or underlayment of a floor covering.
Figure 6:
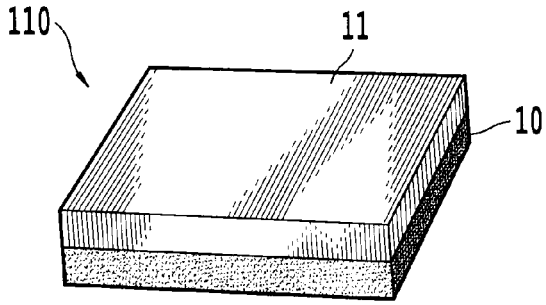
FIG. 6 shows a perspective view of a portion of the acoustic device in FIG. 5.

The example in FIG. 5 shows the latter configuration. The flexible layer 10 is combined with the rigid layer 11 to form a plate 110 (FIG. 6), whereof a plurality is bonded to the floor 3, while the damping element 13, which is in the form of an adhesive film, is unwound on the whole of the plates, the covering 2 being then bonded on top.

Figure 7:
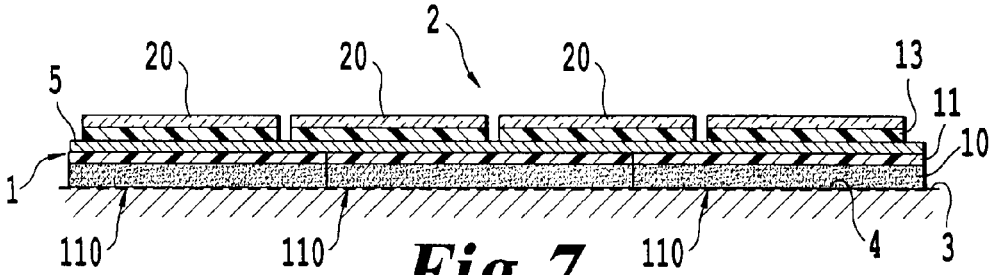
FIG. 7 shows another alternative of FIG. 5.
Figure 8:
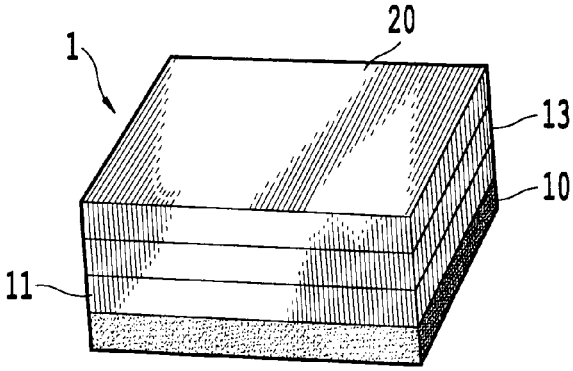
FIG. 8 is a perspective view of a portion of the acoustic device in FIG. 7.

In the example in FIG. 7, a plurality of plates 110 are positioned on the floor while the damping layer 13 is directly bonded to the covering 2. The layer is for example a damping plastic sheet, such as PVB, bonded to the ceramic tile 20 on the face opposite the one intended for walking (FIG. 8). The damping sheet 13 is joined to the covering 2 by the application of a water glue to said covering, or by heating in the case of a polymer resin.

Finally, according to a third alternative, each element of the device is taken individually and combined with the others during the application of the device to constitute a covering underlayer.

Figure 9:
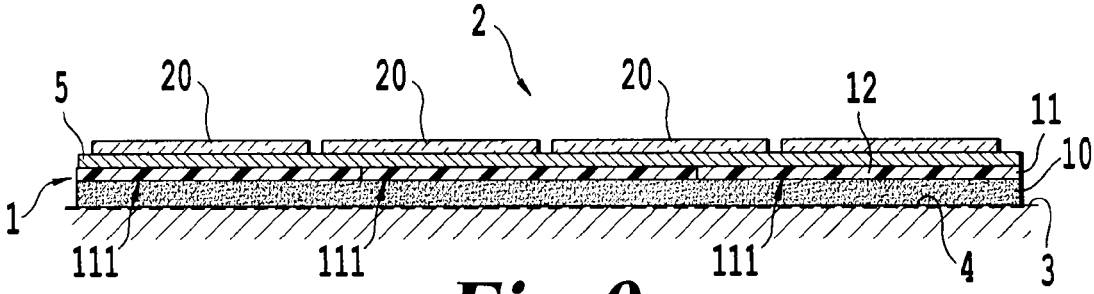
FIG. 9 shows a schematic cross section of an additional alternative embodiment of the acoustic device of the invention integrated as an underlayer or underlayment of a floor covering.
Figure 10:
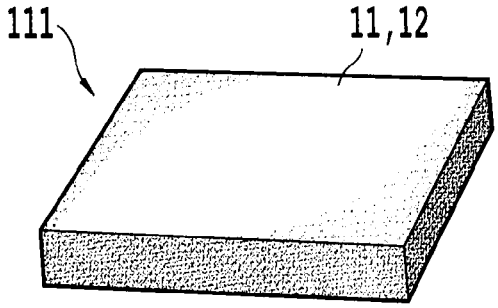
FIG. 10 shows a perspective view of a portion of the acoustic device in FIG. 9.

The example in FIG. 9 shows this configuration, the flexible layer 10 is in the form of a roll and is unwound and positioned against the floor 3 while being cut to the appropriate dimensions of the surface to be covered, while the rigid layer 11, which comprises the damping element 12, is in the form of plates 111 (FIG. 10) which are placed by bonding against the fibrous layer 10 and on which the covering 3 is bonded. In another alternative not shown, it is also possible to pour a mini-leveling screed including the damping element on the flexible layer 10.

Two preferred embodiments of the present invention are:

- wherein the rigid layer (11) considered separately without the damping element has a thickness of at least 3 mm; and
- wherein the damping layer (13) or the rigid layer (11), when the latter integrates the damping element (12), is joined to the covering to be laid on the other elements of said device.

To illustrate the invention, tests were conducted on various devices. The comparative examples and values are explained in the tables below.

The example of Table 1 is a conventional acoustic insulation device. Tables 2, 3 and 4 represent nonlimiting examples of the acoustic enhancement device according to the two distinct embodiments of the invention. Table 5 is a comparative example in which the arrangement of the layers does not conform to the invention.

The performance of the examples is illustrated by the value of the apparent dynamic stiffness per unit area $s'_t$ measured as described above with regard to the acoustic performance of the flexible layer, but on the complete device.

The values of the dynamic Young's modulus and loss factor supplied in these tables for the rigid layer 11 or 12 and for the complete device are obtained at 20° C. by applying the method described in document ISO PAS 16940 by selecting the resonance frequency closest to 1000 Hz. On the contrary, as opposed to the dimensions given in document ISO PAS 16940, the sample measured here comprises three tiles from Desvres, of fine glazed stoneware measuring 200 mm×200 mm×7.5 mm which are separated by 5 mm joints. The batchings and application methods of the mortars-adhesives for tiling, leveling and joints being those rendered by the manufacturer.

The values of the dynamic Young's modulus and loss factor of the damping layer 13 are measured using a viscoanalyzer.

For each example, the same 20 Desvres fine glazed stoneware tiles measuring 200 mm×200 mm×7.5 mm are therefore considered, with the same tiling joint, the same tiling cement 5, here a mineral binder to be mixed such as the "Weber.col plus" product from Weber et Broutin, and the same bonding material 4 between the flexible layer 10 and the floor 3, here an acrylic cement such as the "Weber.sys acoustic" cement from Weber et Broutin.

Table 1 shows a comparative example only comprising one flexible layer 10 and one rigid layer 11 without damper.

TABLE 1

| | Nature of Material |
|---|---|
| Flexible layer (10) | Non-woven needled fabric of polyester fibers: "Weber.sys acoustic" from Weber et Broutin, with $s'_t = 4.2\times10^7$ N/m$^3$ |
| Rigid layer (11) | Fibrous mineral binder to be mixed and to be spread on the flexible layer 10: self-smoothing leveling screed "Weber.sys acoustic", with tanδ = 0.01 E' = $1.5\times10^{10}$ Pa |
| Device associated with floor covering 2 | tanδ = 0.01 E' = $1.5\times10^{10}$ Pa $s'_t = 4.2\times10^7$ N/m$^3$ |

Table 2 shows an example of the invention which resumes the flexible layers 10 and 11 of comparative example 1 and for which the rigid layer 11 includes damping element 12.

TABLE 2

| | Nature of Material |
|---|---|
| Flexible layer (10) | Non-woven needled fabric of polyester fibers: "Weber.sys acoustic" from Weber et Broutin, with $s'_t = 4.2 \times 10^7$ N/m$^3$ |
| Rigid layer (11, 12) | Fibrous mineral binder to be mixed and to be spread on the flexible layer 10: self-smoothing leveling screed "Weber.sys acoustic", and including conventional PVB granules. $\tan\delta = 0.06$ $E' = 1.5 \times 10^{10}$ Pa |
| Device (1) associated with floor covering 2 | $\tan\delta = 0.06$ $E' = 1.5 \times 10^{10}$ Pa $s'_t = 4.2 \times 10^7$ N/m$^3$ |

A comparison of Tables 1 and 2 shows that by adding the damping element 12, the loss factor tan δ of the complete device substantially increases. A gain in damping is thus achieved in order to enhance the acoustic correction of the complete device, that is against walking sound.

Table 3 shows an example of the invention which resumes example 2 but with a different flexible layer.

TABLE 3

| | Nature of Material |
|---|---|
| Flexible layer (10) | Non-woven glass fiber fabric: glass net 450 g/m$^2$ $s'_t = 3.6 \times 10^6$ N/m$^3$ |
| Rigid layer (11, 12) | Fibrous mineral binder to be mixed and to be spread on the flexible layer 10: self-smoothing leveling screed "Weber.sys acoustic", and including conventional PVB granules. $\tan\delta = 0.06$ $E' = 1.5 \times 10^{10}$ Pa |
| Device (1) associated with floor covering 2 | $\tan\delta = 0.06$ $E' = 1.5 \times 10^{10}$ Pa $s'_t = 3.6 \times 10^6$ N/m$^3$ |

Table 3 shows that the acoustic correction remains guaranteed by the damping procured by the damping element, the nature of the flexibility only serving to adjust the acoustic insulation performance.

Table 4 shows an example of the invention which resumes example 3 but instead of having PVB included in the rigid layer, the damping element is present as layer 13.

TABLE 4

| | Nature of Material |
|---|---|
| Flexible layer (10) | Non-woven glass fiber fabric: glass net 450 g/m$^2$ $s'_t = 3.6 \times 10^6$ N/m$^3$ |
| Rigid layer (11) | Fibrous mineral binder to be mixed and to be spread on the flexible layer 10: self-smoothing leveling screed "Weber.sys acoustic", with $\tan\delta = 0.06$ $E' = 1.5 \times 10^{10}$ Pa |
| Damping layer (13) | 0.8 mm thick film of acrylic glue "Weber.sys acoustic" Weber et Broutin, with $\tan\delta = 1.03$ $E' = 1.9 \times 10^7$ Pa |
| Device (1) associated with floor covering (2) | $\tan\delta = 0.34$ $E' = 1.5 \times 10^{10}$ Pa $s'_t = 3.6 \times 10^6$ N/m$^3$ |

A comparison of Table 3 and 4 shows that by using the damping element as a separate layer 13, the damping performance is even further improved with regard to an integration of the element in the rigid layer.

Finally, Table 5 shows a system in which the damping layer 13, identical to that of Table 4, is on the contrary placed in a manner not conforming to the invention between the flexible layer 10 and the rigid layer 11, and not between the rigid covering 2 and the rigid layer 11.

TABLE 5

| | Nature of Material |
|---|---|
| Flexible layer (10) | Non-woven glass fiber fabric: glass net 450 g/m$^2$ $s'_t = 3.6 \times 10^6$ N/m$^3$ |
| Rigid layer (11) | Fibrous mineral binder to be mixed and to be spread on the flexible layer 10: self-smoothing leveling screed "Weber.sys acoustic", with $\tan\delta = 0.01$ $E' = 1.5 \times 10^{10}$ Pa |
| Damping layer (13) placed between the flexible layer (10) and the rigid layer (11) | 0.8 mm thick film of acrylic glue "Weber.sys acoustic" Weber et Broutin, with $\tan\delta = 1.03$ $E' = 1.9 \times 10^7$ Pa |
| Device (1) associated with floor covering 2 | $\tan\delta = 0.01$ $E' = 1.5 \times 10^{10}$ Pa $s'_t = 3.6 \times 10^6$ N/m$^3$ |

It is observed that the damping tan δ of the complete device is not at all improved (value of 0.01) despite the presence of the damping layer 13, whereas for the example of the invention in Table 4, the value for the device is 0.34. Thus, to provide an enhanced acoustic correction, not only is a damper necessary, but it should be carefully placed between two rigid layers.

The above written description of the invention provides a manner and process of making and using it such that any person skilled in this art is enabled to make and use the same, this enablement being provided in particular for the subject matter of the appended claims, which make up a part of the original description.

As used herein, the words "a" and "an" and the like carry the meaning of "one or more."

The phrases "selected from the group consisting of," "chosen from," and the like include mixtures of the specified materials. Terms such as "contain(s)" and the like are open terms meaning 'including at least' unless otherwise specifically noted.

All references, patents, applications, tests, standards, documents, publications, brochures, texts, articles, etc. mentioned herein are incorporated herein by reference. Where a numerical limit or range is stated, the endpoints are included. Also, all values and subranges within a numerical limit or range are specifically included as if explicitly written out.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein. In this regard, certain embodiments within the invention may not show every benefit of the invention, considered broadly.

The invention claimed is:

1. An acoustic enhancement device adapted for being placed on a support and under a covering, and comprising a first flexible layer adapted for being placed facing the support, a second rigid layer joined to the first flexible layer and adapted for being placed opposite the support, and a damping element, wherein the damping element is integrated in the second rigid layer or forms a third layer placed on the second rigid layer and opposite the first flexible layer, wherein the flexible layer is a layer with open porosity, comprising one or more of fibrous material(s) of mineral and/or synthetic origin, glass fibers, polyester fibers, polyethylene and polyurethane, and having an apparent dynamic stiffness per unit area $s'_t$ lower than $8.8\times10^6 N/m^3$ and wherein, when the damping element is integrated in the second rigid layer, the rigid layer has, at 20° C. and at 1000 Hz, a loss factor tan δ at least equal to 0.06, and, when the damping element forms a third layer, the third layer has, at 1000 Hz and 20° C., a loss factor tan δ at least equal to 0.3 and a dynamic Young's modulus E' of between $5\times10^6$ Pa and $10^8$ Pa.

2. The device as claimed in claim 1, wherein the damping element is integrated in the rigid layer and comprises aggregates selected from the group consisting of balls, granules, scraps of recycled material, and mixtures thereof.

3. The device as claimed in claim 1, wherein the damping element forms a third layer that comprises one or more viscoelastic plastic material(s) selected from the group consisting of a sheet, a film, a poured resin, and a spreadable material.

4. The device as claimed in claim 1, wherein the third layer comprises an adhesive for bonding a covering to the device.

5. The device as claimed in claim 1, wherein the damping element comprises of one or more viscoelastic polymer material(s)selected from the group consisting of EVA based polymers, polymers of the acrylic type, and polymers of the polyvinyl butyral type.

6. The device as claimed in claim 1, wherein the rigid layer considered separately without the damping element has, at 20° C. and at 1000 Hz, a dynamic Young's modulus E' of $10^9$ Pa to $30\times10^9$ Pa.

7. The device as claimed in claim 1, wherein the rigid layer considered separately without the damping element has a thickness of at least 3 mm.

8. The device as claimed in claim 1, wherein the second rigid layer is comprises at least one of an organic bonder, a mineral binder, bitumen, agglomerated fibers, and a synthetic composite material.

9. The device as claimed in claim 1, wherein the first flexible layer has a thickness $d_F$ of between 3 and 7 mm under a load of 2 kPa.

10. The device as claimed in claim 1, wherein it is in the form of a plate.

11. The device as claimed in claim 1, wherein the first flexible layer is in the form of a roll to be spread and to be cut to the dimensions of the surface of the support to be covered.

12. The device as claimed in claim 11, wherein the second rigid layer integrates the damping element.

13. The device as claimed in claim 1, wherein the damping element, or the rigid layer when the rigid layer integrates the damping element, is joined to the covering to be laid on the other elements of said device.

14. The device as claimed in claim 1, wherein it is an underlayer or underlayment for a floor, wall or ceiling covering.

15. The device as claimed in claim 1, wherein when the damping element is integrated in the second rigid layer, the rigid layer has a loss factor tan δ higher than 0.1.

16. The device as claimed in claim 1, wherein when the damping element forms a third layer, the damping element is positioned on the rigid layer opposite the flexible layer.

17. An acoustic enhancement device adapted for being placed on a support and under a covering, and comprising a first flexible layer adapted for being placed facing the support, a second rigid layer joined to the first flexible layer and adapted for being placed opposite the support, and means for damping, wherein the means for damping are integrated in the second rigid layer or form a third damping layer placed on the second rigid layer and opposite the first flexible layer, wherein the flexible layer is a layer with open porosity, comprising one or more of fibrous material(s) of mineral and/or synthetic origin, glass fibers, polyester fibers, polyethylene and polyurethane, and having an apparent dynamic stiffness per unit area $s'_t$ lower than $8.8\times10^6 N/m^3$ and wherein, when the damping element is integrated in the second rigid layer, the rigid layer has, at 20° C. and at 1000 Hz, a loss factor tan δ at least equal to 0.06, and, when the damping element forms a third layer, the third layer has, at 1000 Hz and 20° C., a loss factor tan δ at least equal to 0.3 and a dynamic Young's modulus E' of between $5\times10^6$ Pa and $10^8$ Pa.

* * * * *

UNITED STATES PATENT AND TRADEMARK OFFICE

CERTIFICATE OF CORRECTION

PATENT NO. : 8,066,097 B2
APPLICATION NO. : 12/506537
DATED : November 29, 2011
INVENTOR(S) : Pierre Boyadjian et al.

It is certified that error appears in the above-identified patent and that said Letters Patent is hereby corrected as shown below:

Column 3, line 50, "5x10 Pa" should read --$5x10^6$ Pa--;
Column 4, line 29, "dF" should read --$d_F$--;

Signed and Sealed this
Third Day of April, 2012

David J. Kappos
*Director of the United States Patent and Trademark Office*